US007389896B2

(12) United States Patent
Andersson et al.

(10) Patent No.: US 7,389,896 B2
(45) Date of Patent: Jun. 24, 2008

(54) DEVICE FOR JETTING DROPLETS OF A PARTICLE FILLED VISCOUS MEDIUM

(75) Inventors: Tommy Andersson, Tyresö (SE); Johan Berg, Uppsala (SE); Nils Fyhr, Sollentuna (SE); Johan Kronstedt, Sollentuna (SE); Kenth Nilsson, Åkersberga (SE)

(73) Assignee: Mydata Automation AB, Bromma (SE)

( * ) Notice: Subject to any disclaimer, the term of this patent is extended or adjusted under 35 U.S.C. 154(b) by 563 days.

(21) Appl. No.: 10/495,190

(22) PCT Filed: Nov. 5, 2002

(86) PCT No.: PCT/SE02/02003

§ 371 (c)(1),
(2), (4) Date: May 11, 2004

(87) PCT Pub. No.: WO03/041876

PCT Pub. Date: May 22, 2003

(65) Prior Publication Data

US 2004/0262824 A1 Dec. 30, 2004

(30) Foreign Application Priority Data

Nov. 12, 2001 (SE) ..... 0103737

(51) Int. Cl.
*C22B 1/00* (2006.01)

(52) U.S. Cl. ..... 222/594; 222/591; 266/227

(58) Field of Classification Search ..... 222/591, 222/594; 266/227; 228/33; 604/190
See application file for complete search history.

(56) References Cited

U.S. PATENT DOCUMENTS 4,942,998 A * 7/1990 Horvath et al. ..... 228/102
5,397,048 A 3/1995 Konno et al.

FOREIGN PATENT DOCUMENTS

WO WO 99/64167 A1 12/1999

* cited by examiner

*Primary Examiner*—Scott Kastler
(74) *Attorney, Agent, or Firm*—Birch, Stewart, Kolasch & Birch, LLP

(57) ABSTRACT

This invention relates to a device for jetting droplets of a particle filled viscous medium. The device has a nozzle, an eject mechanism connected to the nozzle, a medium feeding mechanism connected to the eject mechanism, a particle filled viscous medium container connected to the medium feeding mechanism, and a filter arranged between an outlet of the particle filled viscous medium container and the medium feeding mechanism.

12 Claims, 2 Drawing Sheets

DEVICE FOR JETTING DROPLETS OF A PARTICLE FILLED VISCOUS MEDIUM

TECHNICAL FIELD

This invention relates to a device for jetting droplets of a particle filled viscous medium, such as solder paste.

TECHNICAL BACKGROUND

In the non-contact viscous medium dispensing technology called jetting, which has been developed in the course of the recent years, a central issue is how to generate droplets of a predetermined size at a predetermined pace. In many respects this technology is superior to other available dispensing technologies. However, at an early stage, when jetting viscous medium containing a substantial amount of particles, such as solder paste, a problem encountered was an unexpected interference and unintentional interruption of the series of consecutive solder paste droplets jetted from the device.

Since the solder paste is a most special type of medium consisting of a solder powder, i.e. small metal grains, solved in a viscous flux, and since the jetting technology is rather an extreme variety of dispensing, it was initially presumed that the problem could be overcome by improving the mechanical parts of the jetting device. Indeed some mechanical causes were found, such as smearing of the solder powder at narrow passages. These deficiencies have been corrected, and yet occasionally similar problems occur. The reasons therefore are still to be found.

SUMMARY OF THE INVENTION

The object of this invention is to provide a solution to the problem of interference and interruption described above.

The object is achieved by a device according to the appended claims.

In accordance with one aspect of the present invention there is provided a device for jetting droplets of a particle filled viscous medium, comprising a nozzle, an eject mechanism connected to the nozzle, a medium feeding mechanism connected to the eject mechanism, a particle filled viscous medium container connected to the medium feeding mechanism, and a filter arranged between an outlet of the particle filled viscous medium container and the medium feeding mechanism.

Surprisingly it turns out that the filter eliminates, or at least substantially reduces, the problems of interference, and temporary and lasting interrupts of the series of droplets jetted from the apparatus. This indicates a presence of impurities or some kind of large particles in the solder paste. This could not be expected since so far, within this technical field, there had been no indications of this kind of problems with the solder paste. It has then been discovered that the major reason for the problems of different kinds of sudden interferences and temporary or remaining interrupts described above has been contaminations in the solder paste, which have led to clogging of narrow passages of the device. Further, it should be noted that, in addition to solder paste, the device is useful also with other particle filled viscous media having similar viscous properties. Such other particle filled viscous media are, for example, electrically conductive adhesive, and resistive paste. However, for reasons of explanatory simplicity, below the particle filled viscous medium will be exemplified with solder paste.

Further, in accordance with this aspect of the invention, the filter is to be arranged between the particle filled viscous medium container and the mechanism for feeding the particle filled viscous medium into the eject mechanism. This has proven to be the most effective position for the filter, due to existing narrow passages of the medium feeding mechanism which otherwise are likely to be clogged.

According to an advantageous embodiment of the device the filter comprises a sieve, which preferably is a metal sieve. The sieve can be provided with appropriately sized meshes such as to prevent too large particles from passing through the sieve, while not causing an undesired increase in the flow resistance.

According to another embodiment of the device the filter is arranged in a duct, extending between the outlet of the container and the medium feeding mechanism, and the filter further comprises consecutive first and second O-rings. The O-rings abut the inner wall of the duct, and the sieve is positioned between the first O-ring and the second O-ring. The O-rings are preferred because they provide a good seal against the wall of the duct while keeping the sieve in place without any risk of deforming it. If the filter additionally is positioned such that the end of the outlet of the container abuts the first O-ring, the O-ring will also provide a seal between the outlet and the duct preventing the solder paste from passing between the outlet and the internal wall of the duct.

According to yet another embodiment of the inventive device it is arranged to be releasably mountable in a particle filled viscous medium jetting machine. In order to obtain this, the device further comprises a device holder mating with a stand of a jetting machine, and an interface adapted to a complementary interface of the stand, wherein said interface comprises electric, and pneumatic elements for controlling the operation of the device.

Further objects and advantages of the present invention will be discussed below by means of exemplifying embodiments.

BRIEF DESCRIPTION OF THE DRAWINGS

Exemplifying embodiments of the invention will be described below with reference to the accompanying drawings, in which.

DESCRIPTION OF EMBODIMENTS

Figure 1:
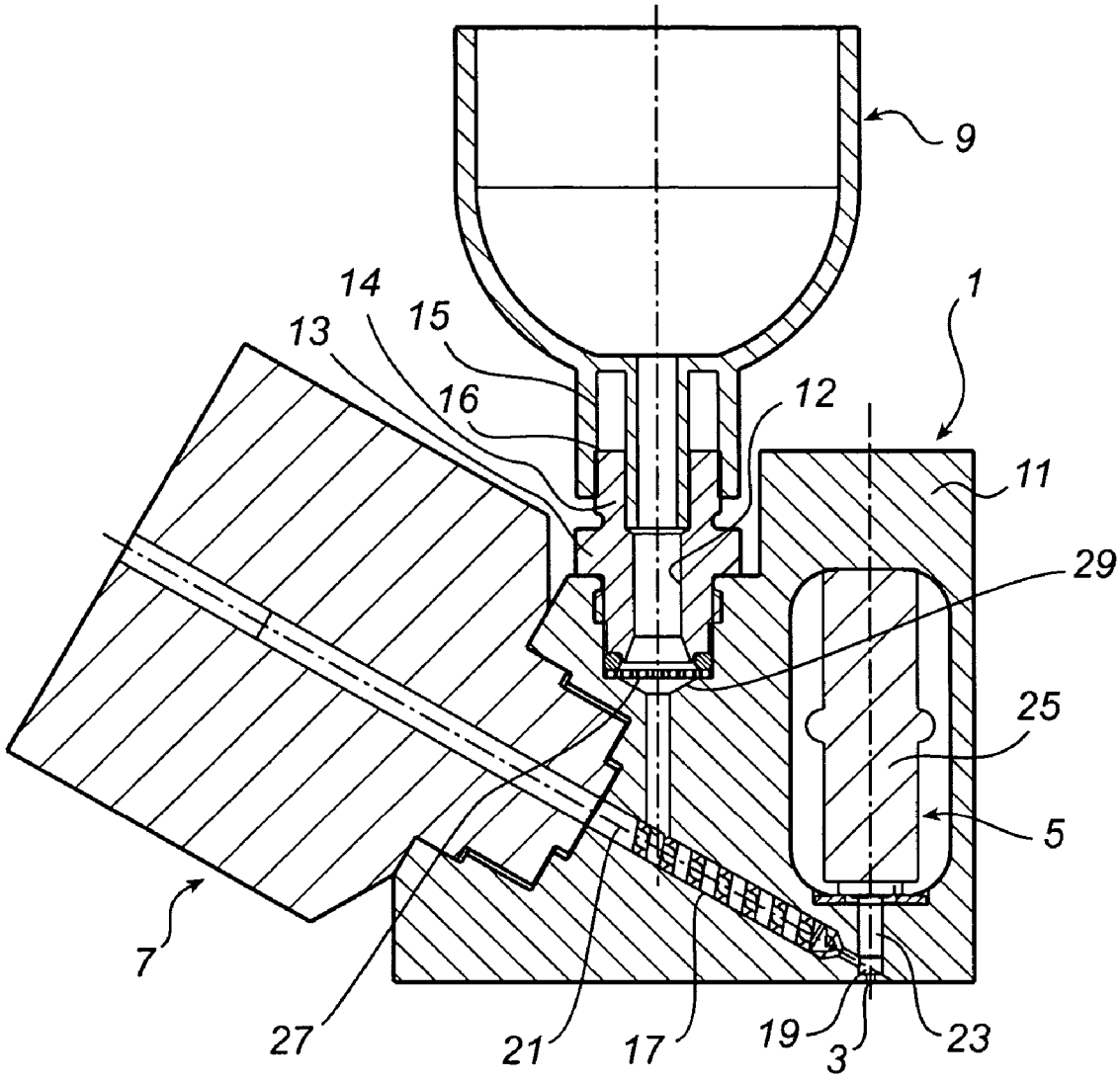
FIG. 1 is a schematic cross-sectional view of a part of an embodiment of a jetting device according to the present invention.

In FIG. 1 the principal structure of an embodiment of a device according the present invention is disclosed. The device 1 comprises a nozzle 3, through which solder paste is ejected, an ejection mechanism 5, a feeding mechanism 7, connected to the ejection mechanism for feeding solder paste into the ejection mechanism, and a solder paste container 9. All those parts are mounted in a body 11 having necessary recesses, borings etc., for mounting the different parts and for guiding the solder paste from the container 9 to the nozzle 3. The path which the solder paste follows on its way to the nozzle comprises an inlet duct 12 extending from a container holder 13, where an outlet portion 15 of the container 9 is received, to the feeding mechanism 7, and more specifically to a feeding tube 17, which extends to the ejection mechanism 5, and more specifically to an eject chamber 19.

The container holder 13 has a cylindrical end portion 14, which has an internal thread. The outlet portion 15 of the container 9 has a corresponding cylindrical outlet end portion 16, which has an external thread, that is matched with said internal thread.

The feeding mechanism comprises a rotatable feeding shaft 21, which in this embodiment is shaped as a feed screw, and which extends along the interior of the feeding tube 17. The ejection mechanism comprises a reciprocatable ejection shaft 23, the end of which defines a wall of the eject chamber 19, connected to an actuator 25, which causes the movement of the ejection shaft 23.

Figure 2:
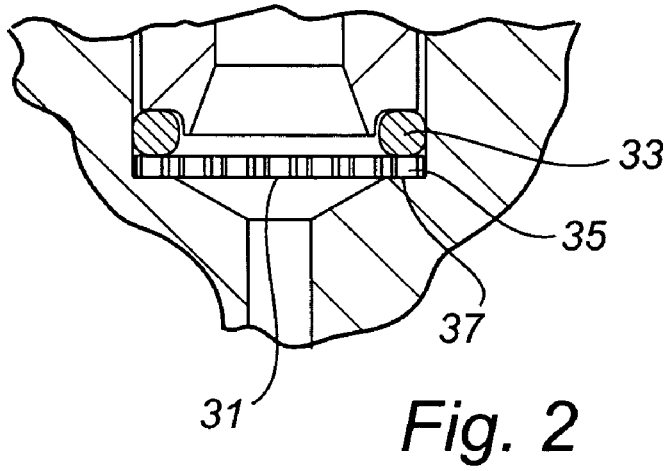
FIG. 2 is an enlargement of a portion of FIG. 1, and illustrates an embodiment of a filter according to the present invention.

A filter 27 is arranged in the inlet duct 12. In this preferred embodiment, the filter 27 is mounted at a filter holding portion 29 of the inlet duct. The filter holding portion is widened so as to reduce the undesired effect of the flow resistance inevitably caused by the filter 27. The filter comprises a sieve 31 and an O-ring 33, as best shown in FIG. 2. A circumferencial edge portion 35 of the filter 27 is supported by a seat, or shelf, 37 formed in the body 11. An O-ring is arranged on a side of the edge portion opposite of the side resting on the seat 37. In this embodiment, the container holder 13 is an individual part, which is mounted in the body 11, wherein the container holder 13 is engaged with the O-ring 33 and keeps the filter 27 in place by forcing, via the O-ring 33, the sieve 31 against the seat 37. The O-ring 33 provides for a seal of the narrow passage between the periferal edge of the sieve 31 and the inner wall of the inlet duct 12, and also protects the sieve from being deformed in conjunction with the mounting of the container holder 13.

When the jetting device 1 is operated the solder paste is fed, by means of the feeding mechanism 7 to the eject chamber 19, and then the actuator 25 is energised, and thereby the ejection shaft 23 is moved rapidly towards the nozzle 3. A droplet is thus jetted from the nozzle towards a surface arranged in a close vicinity of the nozzle. The ejection shaft 23 is then returned to a resting position, and the operation is repeated. The feeding mechanism is supplied with the solder paste through either the influence of gravity or the use of a pressure applied in the container forcing the solder paste out of the container 9. In either case the solder paste is guided through the inlet duct to the feeding mechanism, while passing through the filter 27. The sieve is provided with meshes, i.e. a large number of apertures through which the solder paste passes. The size of the apertures is chosen to be larger than the metal grains of the solder paste but small enough to prevent the troublesome impurities, which are particles significantly larger than the metal grains, of the solder paste from passing the sieve. In the long run the filter 27 is clogged to such a degree that the throughput is decreased to such an extent that the jetting operation is disturbed. Then the filter has to be exchanged. However, this is a simple operation, which is typically performed in conjunction with an exchange of the container 9. Thus, the filter exchange does not significantly affect the effective production time of the jetting device 1.

However, in an alternative embodiment of the device, it is constructed as an exchangeable cassette, or assembly, containing, in excess to the above described parts, an assembly holder mating with a stand of a solder paste jetting machine, and an interface adapted to a complementary interface of the stand. The interface comprises electric, and, possibly, pneumatic elements for controlling the operation of the assembly. In this embodiment, simply, the whole assembly is exchanged when the container is empty or another type of solder paste is to be used. In other words, the jetting device according to this embodiment is releasably mountable in a jetting machine.

In yet another embodiment of the jetting device the fastening of the container in the body is different from that of the embodiment described above. Rather than the threaded portion and the outlet portion the container is provided with a single cylindrical outlet portion 41, which is introduced into a complementary cylindrical portion 43 of the body. The container is retained by means of a resilient locking shackle 44. Further, the filter 45 is arranged at the very end of the outlet portion 41, i.e. at the very beginning of the inlet duct 47. The diameter of the filter 45 is larger than that of the inlet duct 47 in order to reduce the increase of the flow resistance caused by the filter 43. The filter comprises a first, or upper, O-ring 49, a second, or lower, O-ring 51, and a sieve 53 arranged intermediate of the O-rings 49, 51. Thus, in this embodiment of the filter 43, the upper O-ring forms a seal between the end of the outlet portion 41 and the inner wall of the inlet duct 47.

Figure 3:
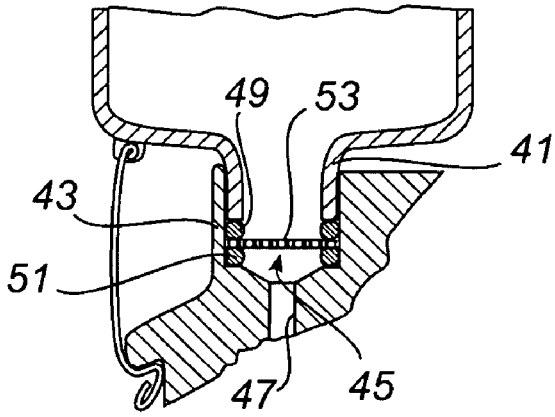
FIG. 3 in a schematic cross-sectional view illustrates another embodiment of a filter mounted in another embodiment of a jetting device, according to this invention.
Figure 4:
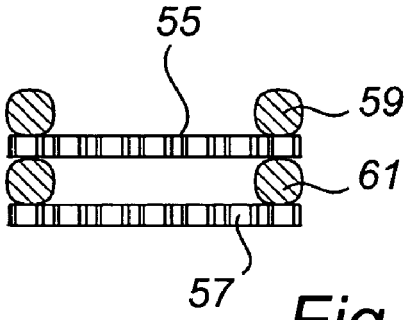
FIG. 4 is a schematic cross-sectional view of yet another embodiment of the filter.

An advantageous alternative embodiment of the filter is a double sieve construction, as shown in FIG. 4. This double sieve construction comprises a first, or upper, sieve 55, a second, or lower, sieve 57, an first, or upper, O-ring 59, and a second, or lower, O-ring 61. This filter is mountable in the embodiment of the jetting device as shown in FIG. 1. Complementing with a third, lowermost, O-ring would make it useful also in the other embodiment of the jetting device as shown in FIG. 3. The first sieve 55, which is the first one as seen in the direction of the flow of solder paste, has a mesh which is coarser than that of the second sieve 57. This embodiment of the filter may stop more contaminations than may the single sieve filter, which has the same mesh size as the second sieve 57 before clogging. This is obtained without any significant increase of the flow resistance.

Above embodiments of the device according to the present invention have been described. These should be seen as non-limiting examples. Many modifications will be possible within the scope of the invention as defined by the claims.

The invention claimed is:

1. A device for jetting droplets of a particle filled viscous medium, comprising;

a nozzle;

an eject mechanism connected to the nozzle;

a medium feeding mechanism connected to the eject mechanism;

a particle filled viscous medium container connected to the medium feeding mechanism; and a filter arranged between an outlet of the particle filled viscous medium container and the medium feeding mechanism.

2. The device according to claim 1, said filter comprising a sieve.

3. The device according to claim 1, said filter comprising a first sieve and a second sieve, wherein the first sieve has larger sized meshes than the second sieve, and wherein the first sieve is arranged closer to the outlet than the second sieve.

4. The device according to claim 2, wherein the filter is arranged in a duct, extending between the outlet of the container and the medium feeding mechanism, wherein the filter further comprises consecutive first and second 0-rings, both abutting the inner wall of the duct, and wherein the sieve is positioned between said first and second O-rings.

5. The device according to claim 3, wherein the filter is arranged in a duct, extending between the outlet of the container and the medium feeding mechanism, wherein the filter further comprises consecutive first, second, and third O-rings, all abutting the inner wall of the duct, and wherein the first sieve is positioned between the first and second O-rings, and the second sieve is arranged between the second and third O-rings.

6. The device according to claim 4, wherein the end of said outlet abuts said first O-ring.

7. The device according to claim 1, wherein the viscous medium is solder paste, and said device is capable of feeding the solder paste.

8. A jetting device comprising: a particle filled viscous medium container;

a medium feeding mechanism connected to said particle filled viscous medium container;

an eject mechanism connected to said medium feeding mechanism:

a nozzle connected to said eject mechanism:

a filter arranged between an outlet of the particle filled viscous medium container and the medium feeding mechanism;

a device holder mating with a stand of a viscous medium jetting machine; and an interface adapted to a complementary interface of the stand, wherein said interface comprises electric and pneumatic elements for controlling the operation of the device.

9. The device according to claim 8, said filter comprising a first sieve and a second sieve, wherein the first sieve has larger sized meshes than the second sieve, and wherein the first sieve is arranged closer to the outlet than the second sieve.

10. The device according to claim 9, wherein the filter is arranged in a duct, extending between the outlet of the container and the medium feeding mechanism, wherein the filter further comprises consecutive first, second, and third O-rings, all abutting the inner wall of the duct, and wherein the first sieve is positioned between the first and second O-rings, and the second sieve is arranged between the second and third O-rings.

11. The device according to claim 10, wherein the end of said outlet abuts said first O-ring.

12. The device according to claim 9, wherein the viscous medium is solder paste, and said device is capable of feeding the solder paste.

* * * * *